US006951382B2

(12) United States Patent
Inui et al.

(10) Patent No.: US 6,951,382 B2
(45) Date of Patent: Oct. 4, 2005

(54) INK JET PRINTING APPARATUS AND INK JET PRINTING METHOD

(75) Inventors: Toshiharu Inui, Kanagawa (JP); Yoshito Mizoguchi, Kanagawa (JP); Takumi Kaneko, Tokyo (JP); Atsushi Arai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/390,729

(22) Filed: Mar. 19, 2003

(65) Prior Publication Data

US 2003/0179257 A1 Sep. 25, 2003

(30) Foreign Application Priority Data

Mar. 25, 2002 (JP) ..... 2002-084406

(51) Int. Cl.[7] ..... B41J 23/00
(52) U.S. Cl. ..... 347/37
(58) Field of Search ..... 347/22, 23, 7, 347/35, 19, 6, 37

(56) References Cited

U.S. PATENT DOCUMENTS 5,784,080 A * 7/1998 Nitta et al. ..... 347/23
5,949,447 A 9/1999 Arai et al. ..... 347/23
5,963,236 A 10/1999 Miyashita et al. ..... 347/85
6,578,943 B2 * 6/2003 Arquilevich et al. ..... 347/15
6,607,259 B2 * 8/2003 Mott et al. ..... 347/18
2003/0137552 A1 * 7/2003 Im et al. ..... 347/23

FOREIGN PATENT DOCUMENTS

JP 8-281967 10/1996 ..... B41J/2/175

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

An ink jet printing apparatus and an ink jet printing method according to the present invention suppress a variation in the density of ink in a supply channel and a print head without the need for useless recovery operations, thus always providing very reliable high-grade images. The ink jet printing apparatus carries out printing using a print head for ejecting ink. The apparatus includes a scanning unit for causing the print head to scan across a printing medium, a measuring unit for measuring a time from an end of a preceding printing operation until a start of a current printing operation, and a determining unit for determining whether or not a result of measurement executed by the measuring unit exceeds a predetermined value. The scanning unit causes the print head to carry out at least one idle scan before the start of a printing operation depending on a result of determination made by the determining unit.

13 Claims, 7 Drawing Sheets

INK JET PRINTING APPARATUS AND INK JET PRINTING METHOD

This application claims priority from Japanese Patent Application No. 2002-084406 filed Mar. 25, 2002, which is incorporated hereinto by reference.

BACKGROUND OF THE INVENTION

1. Field of the Invention

The present invention relates to an ink jet printing apparatus and an ink jet printing method, and more specifically, to an ink jet printing apparatus and an ink jet printing method using pigment ink.

2. Description of the Related Art

More and more ink jet printing apparatuses such as printers, facsimile machines, and copiers which utilize an ink jet printing method have been rapidly placed on the market.

These ink jet printing apparatuses include a print head from which ink droplets are ejected and an ink tank from which ink is supplied to the print head. For these ink jet printing apparatuses in which the print head and the ink tank are integrated together, when the ink in the ink tank is used up, the print head must also be replaced with a new one. Accordingly, a large number of supplies are required, thus increasing running costs.

Thus, in most of the recent ink jet printing apparatuses, the print head and the ink tank are separated from each other so that when the ink in the ink tank is used up, only the ink tank needs to be replaced with a new one. In this case, the running costs decrease compared to the configuration in which the print head and the ink tank are integrated together. However, to further reduce the running costs, the capacity of the ink tank must be increased. Further, when a printing medium (a sheet) of an International Organization for Standardization size A0, B0 or the like is printed on by a large-sized printer, a large amount of ink is used to print one sheet. In this case, the ink tank must be more frequently replaced with a new one unless the number of sheets that can be printed per ink tank is somewhat large. Consequently, the ink tank must have a large capacity.

As the capacity of the ink tank increases, it is necessary to increase the size and weight of a carriage on which the print head and the ink tank are installed to carry out serial scan for printing. When the carriage is heavy, it is difficult to cause the carriage to carry out scan at high speed. In this case, scanning at high speed requires the use of an expensive high-torque motor. This increases the costs of the apparatus.

Thus, a printing apparatus has been put to practical use in which the ink tank is not mounted on the carriage, which carries out scanning, but is fixed in a predetermined area in the ink jet printing apparatus, with only the print head mounted on the carriage and with the print head and the ink tank joined together via a tube or the like. In this apparatus, since only the print head is mounted on the carriage, this apparatus is light and can carry out scanning at high speed, although it is required that the print head and the ink tank are joined together via a tube or the like. Further, the capacity of the ink tank can be increased as required. Accordingly, the capacity may be set taking into account the running costs, the size of the apparatus, the frequency of ink tank replacements, and the like.

FIG. 7 schematically shows a configuration of a printing apparatus in which a print head and an ink tank are joined together via a tube. Reference numeral 1 denotes a print head mounted on a carriage (not shown), and a reference numeral 5 denotes an ink tank. Reference numeral 3 denotes a supply tube that joins the print head 1 and the ink tank 5 together, and reference numeral 4 denotes an atmospheric communication tube. When a printing operation is performed using the print head 1, the ink in the ink tank 5 is fed from the ink tank 5 to the print head 1 via the supply tube 3. On the other hand, an amount of air corresponding to an amount of ink supplied is introduced into the ink tank through the atmospheric communication tube 4. With this configuration, the size of the ink tank can be freely set according to the application. Accordingly, a large ink tank can be designed when it is expected that a large amount of ink is used as in the case with large-sized printers or network printers.

As an application of the large-sized printer, there has been a growing demand for printing of materials intended for outdoor display such as posters. Materials intended for outdoor display (printing sheets) require weathering resistance, but dye ink commonly used for conventional ink jet printing apparatuses has insufficient weathering resistance. In particular, relating to light or gas resistance, the dye ink may change over time and may thus be significantly discolored. Although the dye ink has been improved to exhibit higher weathering resistance under relatively favorable conditions, e.g., indoors, this weathering resistance is still far from the outdoor use level. For large-sized sheets, materials intended for outdoor display may comprise a laminate applied to a printed sheet. In this case, however, although the gas resistance is improved, the light resistance is not at a practical level.

Thus, apparatuses have been put to practical use which employ pigment ink instead of dye ink. Normally, the dye ink is a solution that the dye is dissolved thereinto, whereas the pigment is a solution that the pigment particles are dispersed therein. The long-term dispersion stability of the pigment particles is a very important factor of printing apparatuses that can always provide very reliable high-grade outputs. The dispersion stability of the pigment markedly affects the type or composition of a dispersant such as resin or an activator which is used for dispersion. However, it is difficult to obtain the pigment ink that remains unchanged over a long period. Normally, if the pigment ink is left over a long period, the density of the pigment in the pigment ink will be nonuniform. For example, the density of the pigment may vary between the upper and lower parts of the ink tank. If the apparatus is used under such conditions, the resulting density differs from that obtained if the pigment is uniformly dispersed.

If the apparatus has been out of use over a long period, the dispersability can be improved to some degree by performing a recovery operation with a pump or the like. However, this improvement is not sufficient. Further, the recovery operation may waste a large amount of ink to increase the running costs. Further, the amount of waste ink increases, thus requiring the printing apparatus to have a larger capacity for containing this waste ink. This increases the size and costs of the apparatus.

Thus, the applicant proposed a printing apparatus in which if the apparatus has been out of use over a long period, an ink flow is formed by operating a valve provided in a tube through which ink is supplied and thereby a variation in density within the ink tank is suppressed.

This printing apparatus can make the density in the ink tank uniform but is insufficient to suppress a variation in density within the tube or print head. It is difficult to make the density in the print head uniform simply by carrying out preliminary ejection before the start of printing. Even if dense ink located close to nozzles can be ejected, thinner ink remains close to the print head. Consequently, the resulting printed image has a low grade.

Further, Japanese Patent Application Laid-Open No. 8-281967 (1996) discloses an apparatus in which the supply tube is improved or a projection is provided in the supply tube, in order to suppress a variation in the density of the ink in the tube. Such an apparatus may reduce the degree of freedom for design. It also prevents the use of ordinary tubes, thus complicating the apparatus and increasing the costs.

Thus, the present invention is provided to solve these problems. It is an object of the present invention to provide an ink jet printing apparatus and an ink jet printing method which always provide very reliable high-grade outputs by suppressing a variation in the density of ink within an ink supply passage or print head without performing any useless recovery operations and complicating the configuration of the supply tube.

SUMMARY OF THE INVENTION

To accomplish this object, the present invention provides an ink jet printing apparatus which carries out printing using a print head for ejecting ink, the apparatus being characterized by comprising scanning means for causing the print head to scan a printing medium, measuring means for measuring time from an end of a preceding printing operation till a start of a current printing operation, and determining means for determining whether or not a result of measurement executed by the measuring means exceeds a predetermined value, and in that the scanning means causes the print head to carry out idle scan before the start of a printing operation depending on a result of determination made by the determining means.

Further, a plurality of different predetermined times are provided so that any of them can be used by the determining means as the above predetermined time for the determination. The determining means preferably makes the determination in a plurality of stages according to the plurality of different predetermined times.

Furthermore, the scanning means preferably varies the number of idle scans executed according to the time measured by the measuring means. In this case, if the time measured by the measuring means is relatively long, the scanning means preferably increases the number of idle scans executed, compared to the case in which the measured time is relatively short. Further, the scanning means preferably carries out the idle scan at a speed higher than the speed of normal scan executed by the print head while ejecting ink.

Moreover, this ink is preferably pigment ink.

The ink jet printing apparatus is also characterized by further comprising an ink tank in which the ink is contained and in that the print head and the ink tank are coupled together via a tube channel through which the ink is supplied.

The ink jet printing apparatus is also characterized in that the ink tank comprises agitating means for agitating the ink in the ink tank during the idle scan.

Further, the present invention provides an ink jet printing apparatus which carries out printing using a print head for ejecting ink, the apparatus being characterized by comprising scanning means for causing the print head to scan a printing medium, obtaining means for obtaining information corresponding to time from an end of a preceding printing operation till a start of a current printing operation, and determining means for determining whether or not to cause the print head to carry out idle scan before the start of a printing operation on the basis of the information obtained by the obtaining means.

Furthermore, the present invention provides an ink jet printing apparatus which carries out printing using a print head for ejecting ink, the apparatus being characterized by comprising scanning means for causing the print head to scan a printed medium, obtaining means for obtaining information corresponding to time from an end of a preceding printing operation till a start of a current printing operation, and determining means for determining the number of idle scans executed before the start of a printing operation on the basis of the information obtained by the obtaining means.

The present invention provides an ink jet printing method of carrying out printing using a print head for ejecting ink, the method being characterized by comprising a scanning step of causing the print head to scan a printing medium, a measuring step of measuring time from an end of a preceding printing operation till a start of a current printing operation, and a determining step of determining whether or not a result of measurement executed in the measuring step exceeds a predetermined value, and in that the scanning step includes a step of causing the print head to carry out idle scan before the start of a printing operation depending on a result of determination made in the determining step.

Further, the present invention provides an ink jet printing method of carrying out printing using a print head for ejecting ink, the method being characterized by comprising a scanning step of causing the print head to scan a printing medium, an obtaining step of obtaining information corresponding to time from an end of a preceding printing operation till a start of a current printing operation, and a determining step of determining whether or not to cause the print head to carry out idle scan before the start of a printing operation on the basis of the information obtained in the obtaining step.

Furthermore, the present invention provides an ink jet printing method of carrying out printing using a print head for ejecting ink, the method being characterized by comprising a scanning step of causing the print head to scan a printing medium, an obtaining step of obtaining information corresponding to time from an end of a preceding printing operation till a start of a current printing operation, and a determining step of determining the number of idle scans executed before the start of a printing operation on the basis of the information obtained in the obtaining step.

The above and other objects, effects, features and advantages of the present invention will become more apparent from the following description of embodiments thereof taken in conjunction with the accompanying drawings.

BRIEF DESCRIPTION OF THE DRAWINGS

FIG. 1B is an enlarged view of a recovery means of the ink jet printing apparatus in FIG. 1A;

DETAILED DESCRIPTION OF PREFERRED EMBODIMENTS

The present invention will be described below in detail with reference to the drawings.

The term "idle scan" as used herein refers to an operation of causing a print head to carry out scan without ejecting ink from the print head.

The terms "time (an elapsed time) elapsing after the preceding printing operation has ended and before the current printing operation starts" refers to (1) the time elapsing after the ink ejection from the print head has ended in the preceding printing operation and before the printing apparatus receives a printing operation start signal for the next printing operation. The elapsed time also refers to (2) the time between an operation (a cap close operation) of covering an ejection port surface of the print head with a cap, the operation being performed after the ink ejection from the print head has ended in the preceding printing operation, and an operation (a cap open operation) of separating the ejection port surface of the print head from the cap for the next printing operation. Further, the terms "the ink ejection from the print head has ended in the preceding printing operation" may refer to the end of ink ejection from the print head based on image data for forming an image, or the end of preliminary ejection of ink from the print head onto recovery means which is carried out after the ink ejection from the print head based on image data has ended.

Figure 1A:
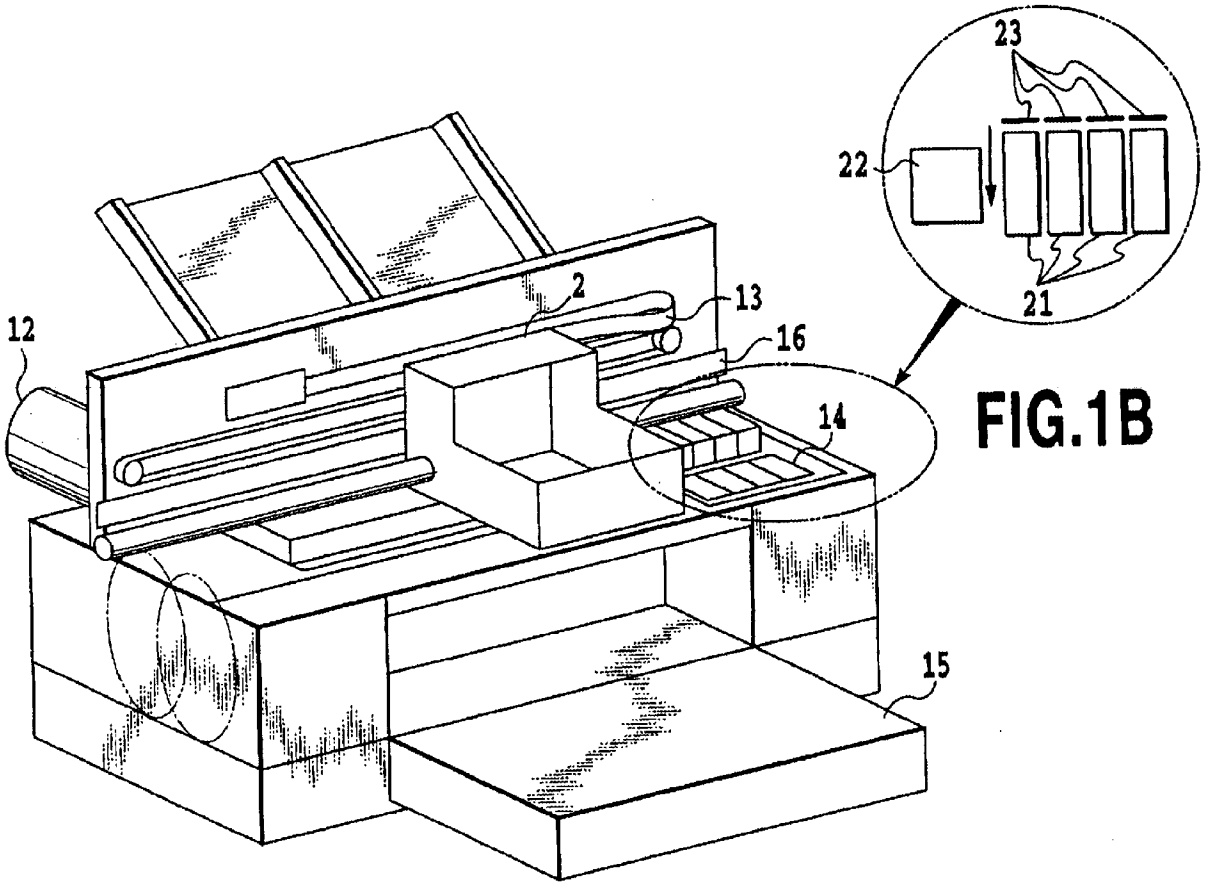
FIG. 1A is a schematic view of an ink jet printing apparatus according to the present invention.

FIG. 1A shows the perspective view of essential parts of an ink jet printing apparatus (hereinafter also referred to as a "printer") to which the present invention is applicable. This ink jet printing apparatus is of a so-called serial scan type that prints an image while scanning an ink jet print head in a direction (main scanning direction) orthogonal to a direction (sub-scanning direction) in which printing media are conveyed.

The apparatus comprises a carriage 2 on which an ink jet print head (hereinafter referred to as a "print head") is mounted, a carriage motor 12 that moves the carriage in the main scanning direction, a flexible cable 13 through which an electric signal is transmitted from a control section (not shown) of the printer to the print head, recovery means 14 for executing a recovery process on the print head, a sheet feeding tray 15 in which printing sheets or printed materials are stacked and stored, an optical position sensor 16 that optically detects the position of the carriage, and others. The ink jet printing apparatus, configured as described above, causes the carriage 2 to carry out serial scan to create a print with a width corresponding to ejection ports (the number of nozzles) in the print head. On the other hand, during non-printing, the apparatus intermittently conveys the printing sheets.

Furthermore, in an enlarged view of the recovery means 14 as shown FIG. 1B, reference numeral 21 denotes a cap for suction and protection. The cap 21 covers the ejection port surface of the print head during a non-printing operation. On the other hand, it opens the ejection port surface of the print head during a printing operation. Reference numeral 22 denotes an ejected ink receiver that receives ink ejected during ejection recovery. Reference numeral 23 denotes wiper blades that wipe the ejection port surface of the print head. The wiper blades wipe the surface while moving in the direction of the arrow in the FIG. 1B.

Figure 2:
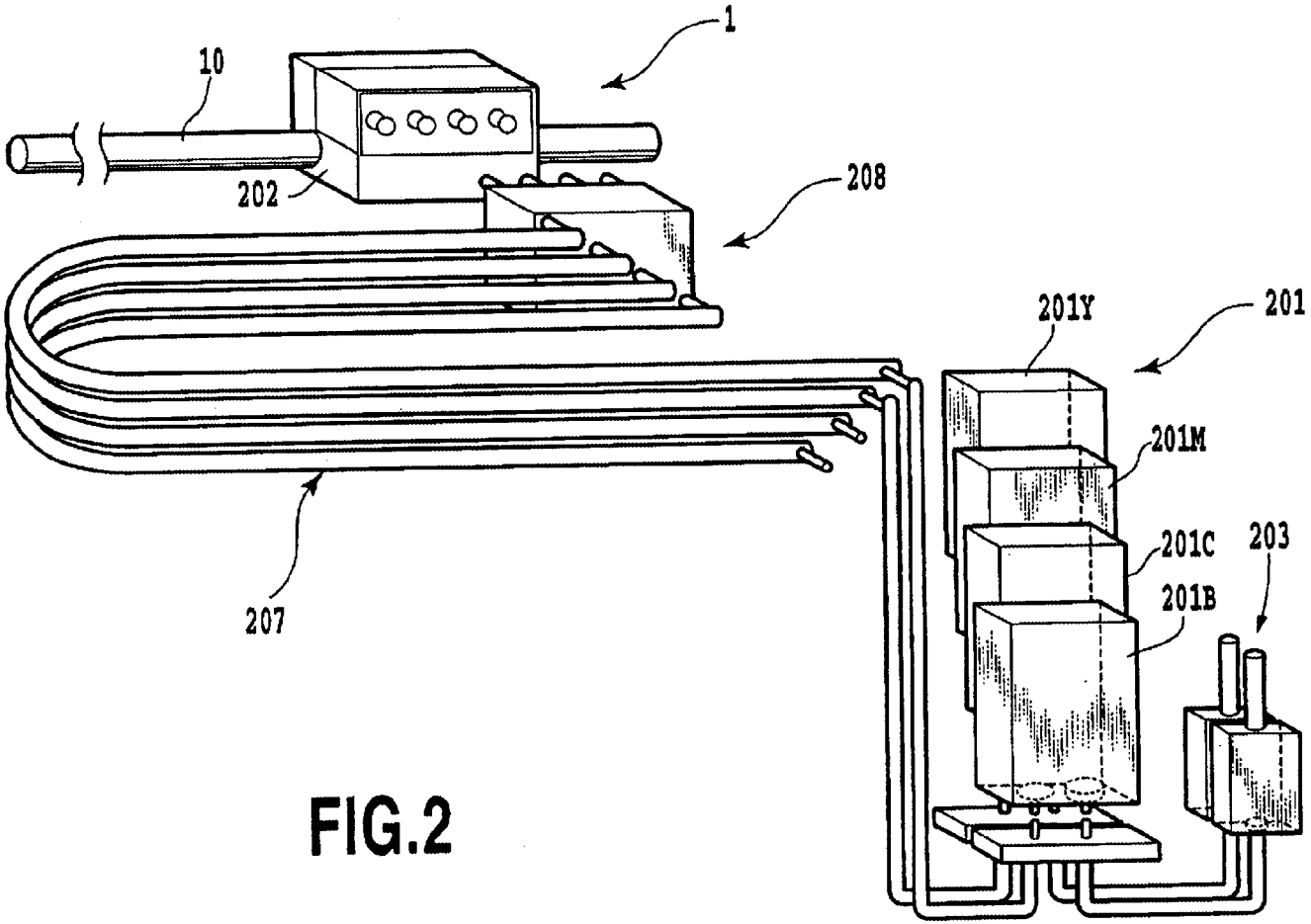
FIG. 2 is a schematic view of an ink supply system in the ink jet printing apparatus shown in FIG. 1A.

FIG. 2 illustrates a printing apparatus in which the print head and the ink tank are joined together via tube.

After flowing from a main ink tank 201 through a tube 207 and a joint 208, ink is filled into a sub ink tank 202 on a carriage. The ink is then supplied to a print head 1. In the ink tank 201, reference numerals 201Y, 201M, 201C, and 201B refer to yellow, magenta, cyan, and black ink containing sections, respectively. The print head 1 moves in the main scanning direction along a shaft 10 together with the carriage 2. Reference numeral 203 denotes a buffer chamber.

Ink may be fed from the main tank 201 provided at a specified position of the apparatus main body, directly to the print head 1. However, in order to increase printing speed and reduce the size and weight of the apparatus while reducing loads on the carriage 1, it is effective to reduce the size of the sub-tank 202, mounted on the carriage 2, as in the present example. That is, it is effective in increasing printing speed and reducing the size and weight of the apparatus to mount the sub tank 202 with a relatively small capacity on the carriage 2, feed ink from the sub tank 202 to the print head 1, and supply ink into the sub tank 202 from the main tank 201 with a relatively large capacity, fixed to a predetermined position of the apparatus main body. A supply joint 208 forms an ink supply passage between the main tank and the sub tank after the carriage 2 has moved to a predetermined position such as a home position. Consequently, ink from the main tank 201 can be supplied to the sub tank 202 during the optimum period based on the capacity of the sub tank 202 or the amount of ink consumed by the print head 1.

Figure 3:
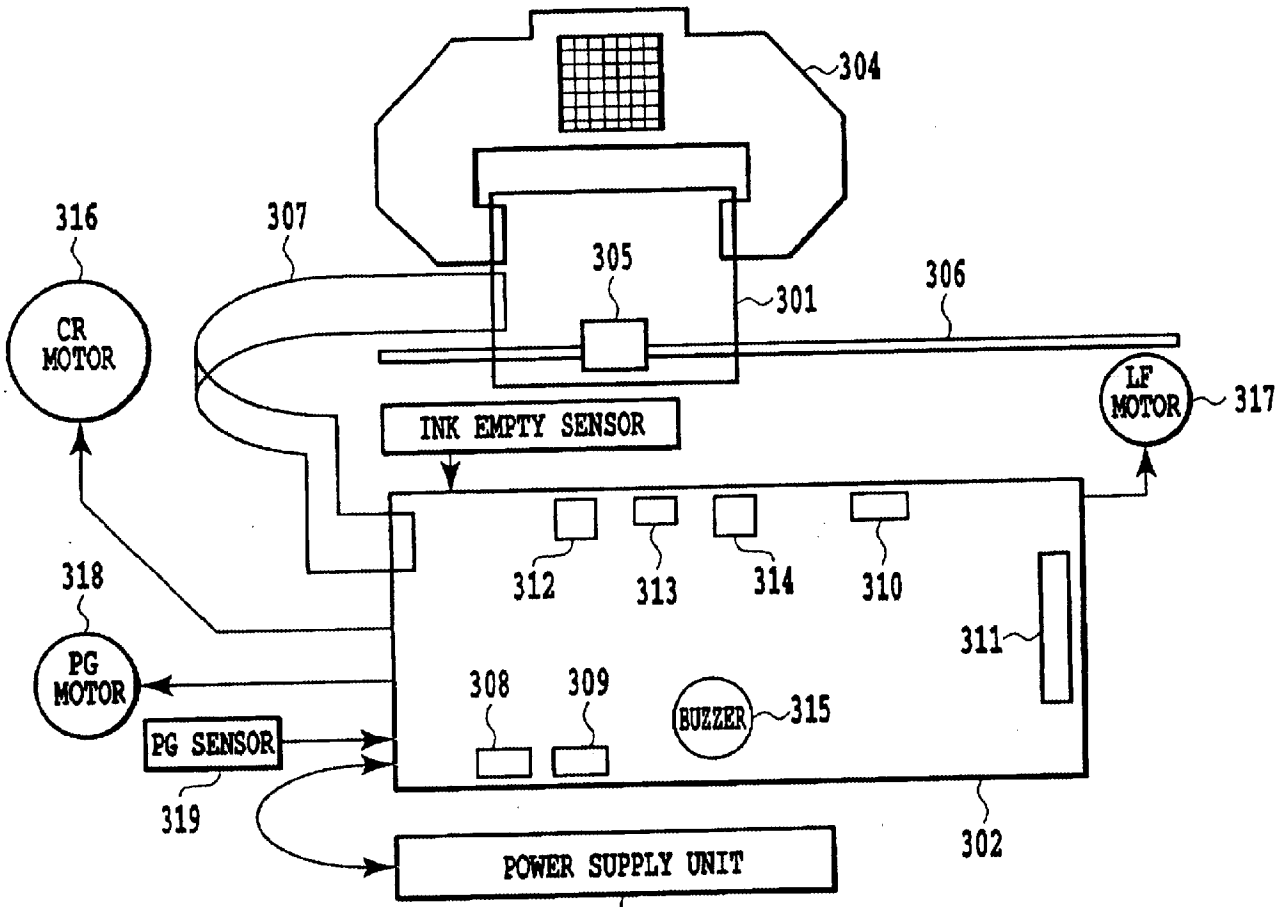
FIG. 3 is a schematic view of entire configuration of an electric circuit in the ink jet printing apparatus shown in FIG. 1A.

FIG. 3 schematically shows the entire configuration of an electric circuit according to this embodiment.

The electric circuit according to this embodiment mainly includes a carriage board 301, a main PCB (Printed Circuit Board) 302, a power supply unit 303, and others. In this case, the power supply unit is connected to the main PCB 302 to provide various driving power sources. Further, the carriage board 301 is a printed circuit board unit mounted on the carriage 2 (FIG. 1A). It functions as an interface that transmits and receives signals to and from the print head through the contact flexible printed circuit (the contact FPC) 304. Further, on the basis of a pulse signal output by an encoder sensor 305 as the carriage moves, the carriage board 301 detects a change in the positional relationship between an encoder scale 306 and an encoder sensor 305. It then outputs a signal to the main PCB 302 through a carriage flexible flat cable (CRFFC) 307.

Furthermore, the main PCB is a printed circuit board unit responsible for driving and controlling each section of the ink jet printing apparatus according to this embodiment. The main PCB comprises I/P ports provided on a board for a paper end detecting sensor (PE sensor) 308, an auto sheet feeder sensor (ASF sensor) 309, a cover sensor 310, a parallel interface (parallel I/F) 311, a resume key 312, an LED 313, a power supply key 314, a buzzer 315, and other components. The main PCB is further connected to a carriage motor (CR motor) 316, a line feeder motor (LF motor) 317, and a purge motor (PG motor) 318 to control their driving. It also has connection interfaces with a PG sensor 319, a CRFFC 307, and the power supply unit 303.

Figure 4:
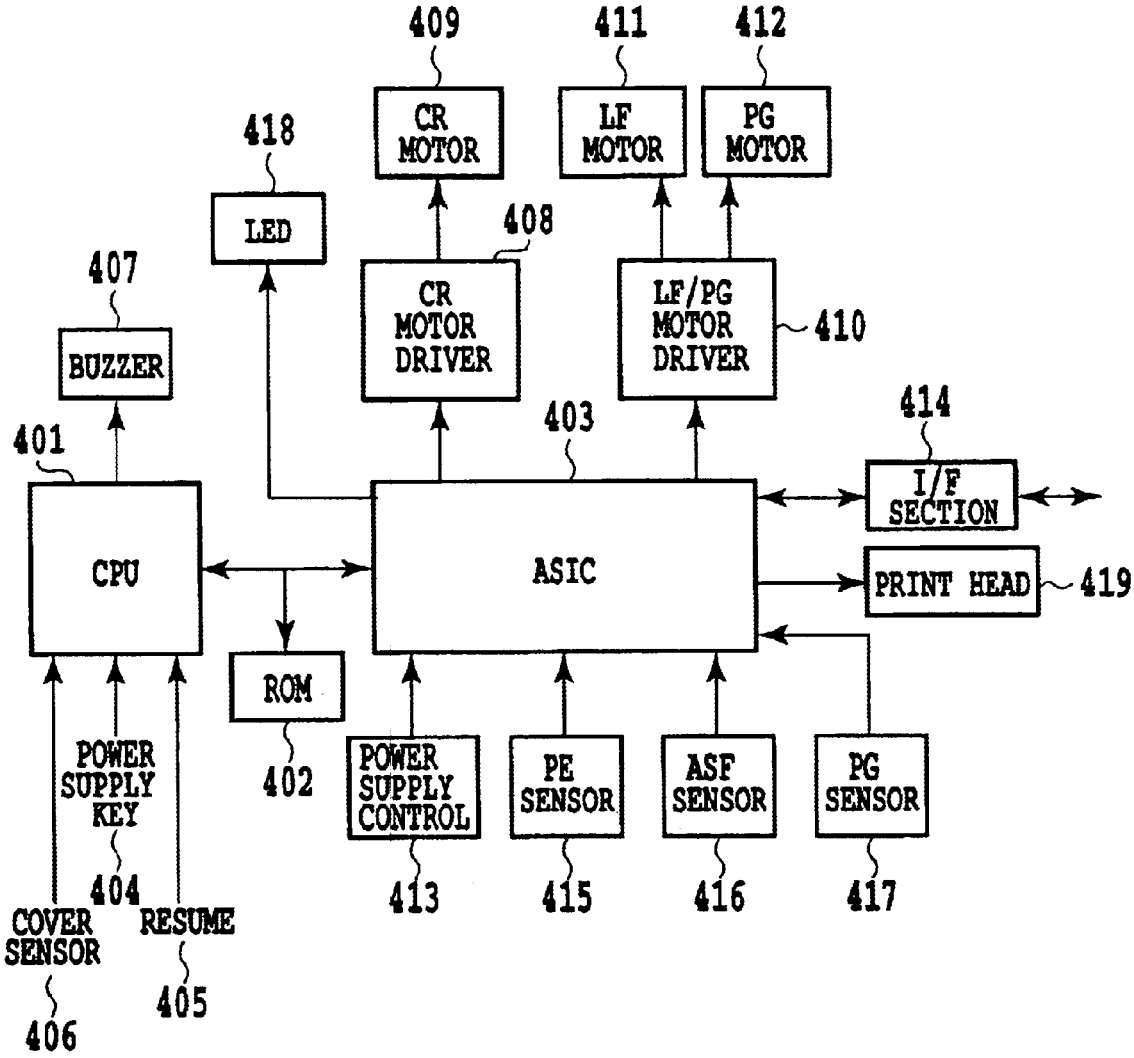
FIG. 4 is a schematic view of a control block in the ink jet printing apparatus shown in FIG. 1A.

FIG. 4 is a block diagram of the main PCB of the printing apparatus according to the present embodiment. In this figure, reference numeral 401 denotes a CPU responsible for driving and controlling a print head 419 and the ink jet printing apparatus. The CPU 401 is connected to a ROM 402 and an application specific integrated circuit (ASIC) 403 through a control bus. According to programs stored in the ROM, the CPU 401 executes various logical operations, condition determinations, and the like. For example, it controls the ASIC and detects an input signal 404 from the power supply key, an input signal 405 from the resume key, and a cover detection signal 406. It also drives a buzzer 407 in response to a buzzer signal (BUZ). Further, the CPU 401 has a timer function to measure the time elapsing from the preceding printing operation till the current printing operation, described later.

Reference numeral 408 denotes a CR motor driver. According to a CR motor control signal from the ASIC 403, the CR motor driver 408 generates a CR motor driving signal to drive a CR motor 409. Reference numeral 410 denotes an LF/PG motor driver. According to a pulse motor control signal (PM control signal) from the ASIC 403, the LF/PG motor driver 410 generates an LF motor driving signal to drive an LF motor 411. The LF/PG motor driver 410 also generates a PG motor driving signal to drive a PG motor 412.

Reference numeral 413 denotes a power supply control circuit. According to a power supply control signal from the ASIC 403, the power supply control circuit 413 controls power supplies to sensors having light emitting elements. A parallel I/F 414 transmits a parallel I/F signal from the ASIC 403 to an externally connected parallel I/F cable. It also transmits a signal from the parallel I/F cable to the ASIC 403.

The ASIC 403 is a semiconductor integrated circuit composed of one chip. It is controlled by the CPU 401 through the control bus to output the previously described CR motor control signal, PM control signal, and power supply control signal as well as a head power supply ON signal, a motor power supply ON signal, and the like to transmit and receive signals to and from the parallel I/F 414. The ASIC 403 also detects the state of a PE detection signal from a PE sensor 415, an ASF detection signal from an ASF sensor 416, and a PG detection signal from a PG sensor 417. It then transmits this state to the CPU 401 by controlling data indicative of the state. On the basis of the input data, the CPU 401 controls driving of an LED driving signal to blink an LED 418.

In the above described printing apparatus, the time elapsing from the preceding printing operation till the current printing operation (the time elapsing after the preceding printing operation has ended and before the current printing operation starts) is measured. Then, on the basis of the measured time, the carriage is caused to carry out idle scan before a printing operation. This idle scan vibrates and agitates the ink in the supply tube 207 and sub tank 202. This serves to avoid the nonuniform density of the ink in the supply tube 207 and in the sub tank 202 of the print head. It is therefore possible to prevent a change in printing density and to maintain the favorable characteristics of ejection of ink droplets from the print head.

The present invention will be described below in further detail with reference to specific embodiments.

(First Embodiment)

Figure 5:
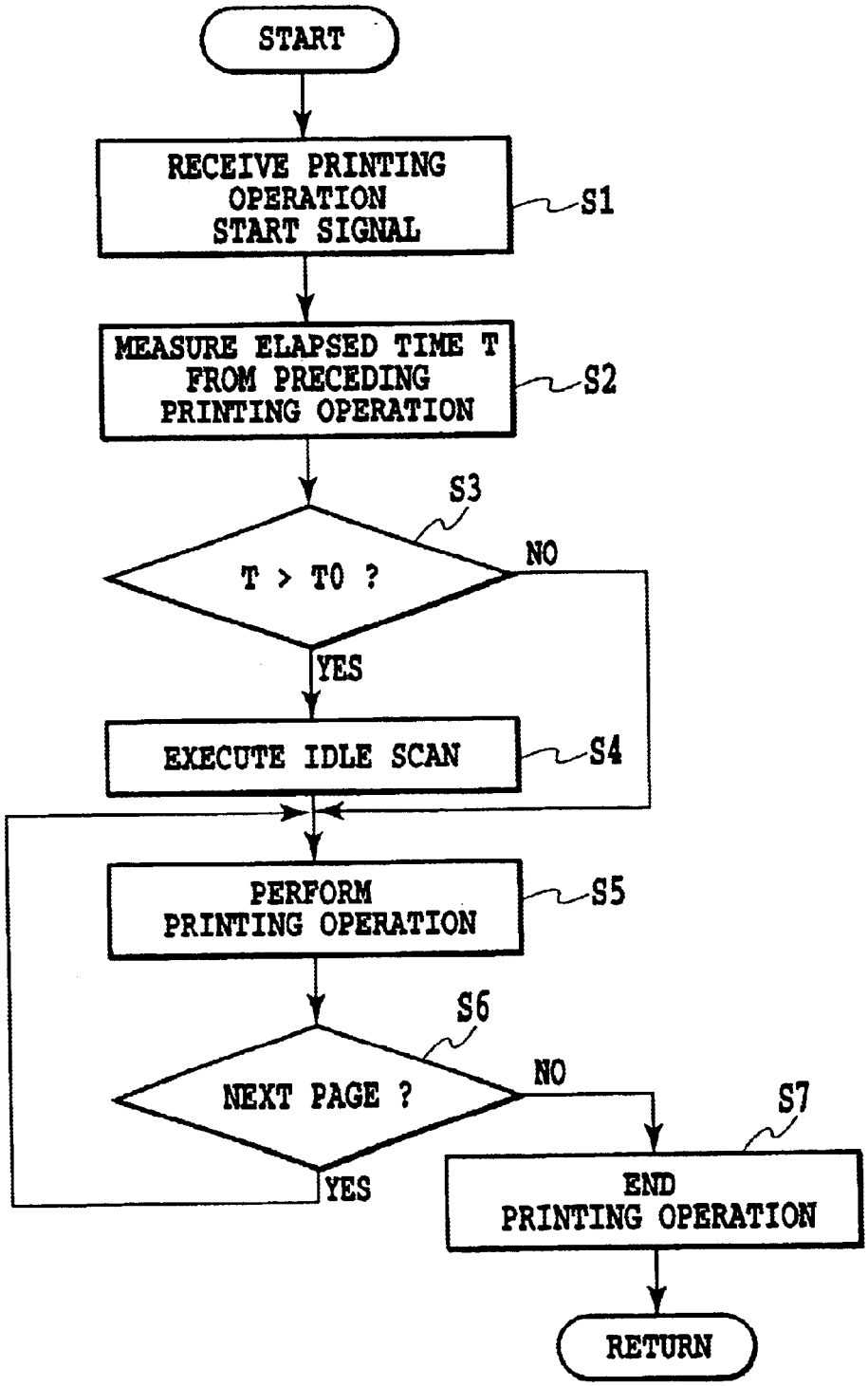
FIG. 5 is a flow chart illustrating a printing operation according to a first embodiment.

FIG. 5 illustrates an operational procedure according to a first embodiment.

First, at step S1, the printing apparatus receives a printing operation start signal. At step S2, the time T elapsing after the preceding printing operation has ended and before the current printing operation starts is measured. In this case, the elapsed time T is measured as described below. The CPU in FIG. 4 reads out the end time (latest end time) of the preceding printing operation stored in a memory section (not shown). The CPU 401 then subtracts this end time from the current time to obtain the elapsed time from the end of the preceding printing operation. Subsequently, at step S3, it is determined whether or not the measured time T exceeds a predetermined time T0. If the measured time T exceeds the predetermined time T0, idle scan is carried out at the next step S4. In the present embodiment, the predetermined time T0 is 72 hours, and the idle scan is carried out three times. After the idle scan has ended, a printing operation is performed on the basis of image data at the subsequent step S5. If the elapsed time T does not exceed the predetermined time T0, the idle scan is not carried out. Then, a printing operation is performed at step S5. At step S6, it is determined whether or not the next printing (printing of the next page) is to be executed. If the next printing (printing of the next page) is not to be executed, the printing operation is ended at step S7. If the next printing (printing of the next page) is to be executed, the printing operation is continued. At step S7, not only the printing operation is ended but the end time of the current printing operation is stored in the memory section (not shown). Further, the end of the printing operation at step S7 may refer to (1) the end of ejection of ink from the print head based on image data, (2) the end of preliminary ejection of ink from the print head onto the recovery means which ejection is carried out after the ejection of ink from the print head based on image data has ended, or (3) the end of operation (cap close operation) of covering the ejection port surface of the print head with the cap, which is preformed after the ejection of ink from the print head based on image data has ended.

Further, in the flow chart in FIG. 5, the time of reception of a printing operation start signal by the printing apparatus is defined as the "start of the current printing operation". However, the present invention is not limited to this aspect. For example, the start of operation (cap open operation) of separating the cap from the ejection port surface of the print head may be defined as the "start of the current printing operation".

As described above, in the present embodiment, if the elapsed time from the preceding printing operation exceeds the predetermined time, i.e., if the ink density is likely to be nonuniform, then the carriage is caused to carry out the idle scan. This makes it possible to avoid the nonuniform density of the ink in the supply tube, print head, and sub-tank (mounted on the carriage together with the print head) before the start of a printing operation. Consequently, high-grade images can be printed. Specifically, in the conventional form in which a printing operation is performed without the idle scan even if the elapsed time from the preceding printing operation exceeds the predetermined time, the ink in the supply tube, print head, and sub tank (mounted on the carriage together with the print head) has a higher density than the ink in the main ink tank. A part of an image which is formed during the initial period of a printing operation (during several scans starting with the first one) has a higher density than the other parts. The resulting image is thus likely to have a varying density. In particular, several milliliters of ink are normally retained in the sub-tank in the print head. The nonuniform density of the ink in the sub-tank results in a significantly nonuniform density in the image printed. On the other hand, in the present embodiment in which if the elapsed time after the preceding printing operation exceeds the predetermined time, the idle scan is carried out before a printing operation is performed. The idle scan agitates the ink in the supply tube and print head (sub tank). This eliminates the difference between the density of the ink in the supply tube, print head, and sub tank (mounted on the carriage together with the print head) and the density of the ink in the main tank. This in turn prevents a part of an image which is formed during the initial period of a printing operation (during several scans starting with the first one) from having a higher density than the other parts. It is thus possible to form a high-grade image with a sufficiently reduced uneven density.

(Second Embodiment)

In the first embodiment, the idle scan is carried out provided that the elapsed time from the preceding printing operation exceeds the predetermined value. However, the number of idle scans executed is set at a fixed value regardless of the elapsed time. If the avoidance of nonuniform density of ink is given the top priority, the number of idle scans executed is desirably set at a large value. However, this increases the printing time. On the other hand, if the reduction of the printing time is given the top priority, the number of idle scans executed is desirably set at a small value. However, this may make it impossible to avoid the nonuniform density of ink.

Thus, in the second embodiment, in order to make the avoidance of nonuniform density of ink and the reduction of the printing time compatible with each other, the number of idle scans executed is varied depending on the elapsed time from the preceding printing operation till the end of the current printing operation. That is, if much time has elapsed from the end of the preceding printing operation, then it is assumed that the ink density is correspondingly nonuniform, to increase the number of times scan is carried out. On the other hand, if only a little time has elapsed from the end of the preceding printing operation, then it is assumed that the ink density is correspondingly uniform, to reduce the number of times scan is carried out.

Figure 6:
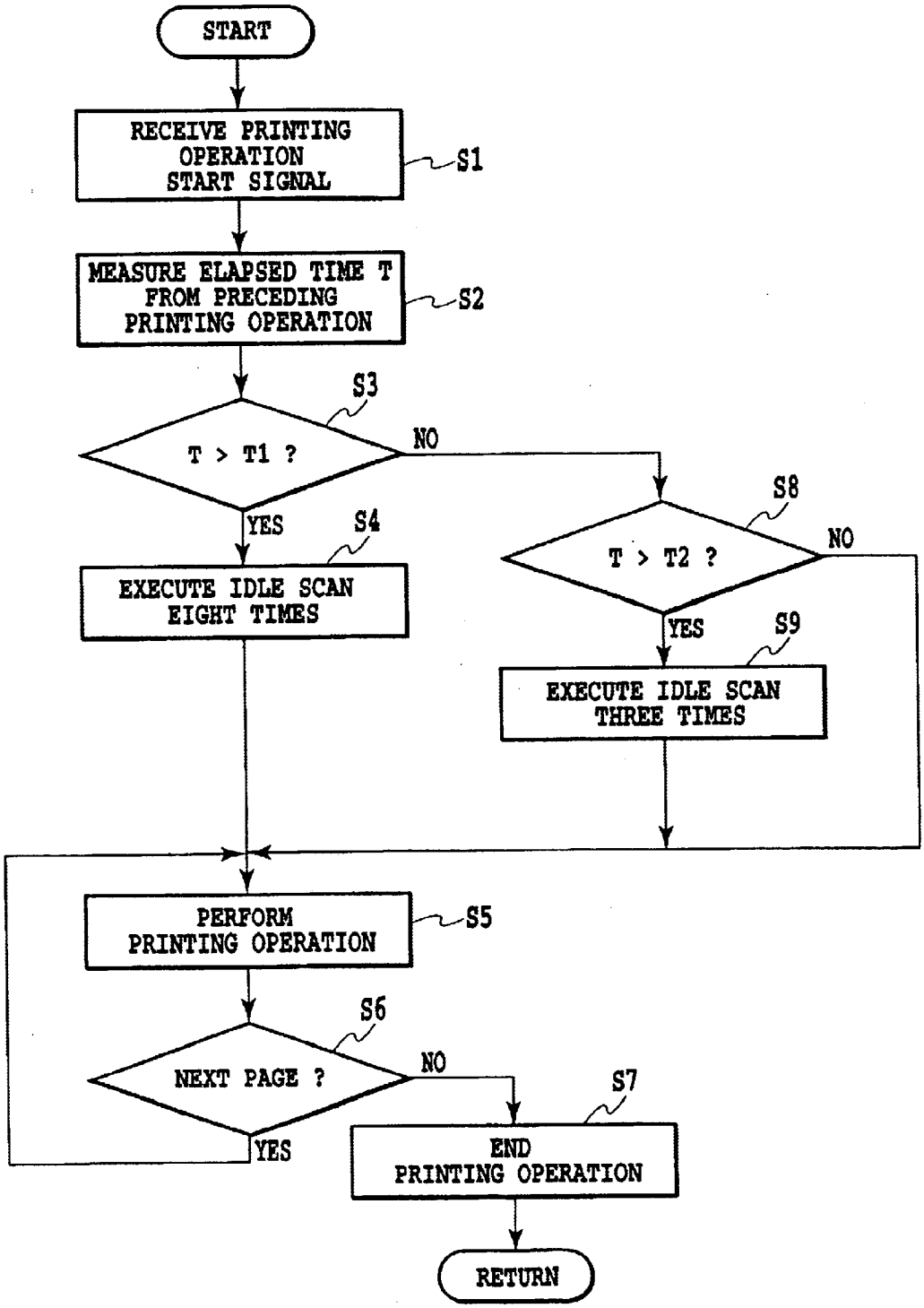
FIG. 6 is a flow chart illustrating a printing operation according to a second embodiment.
Figure 7:
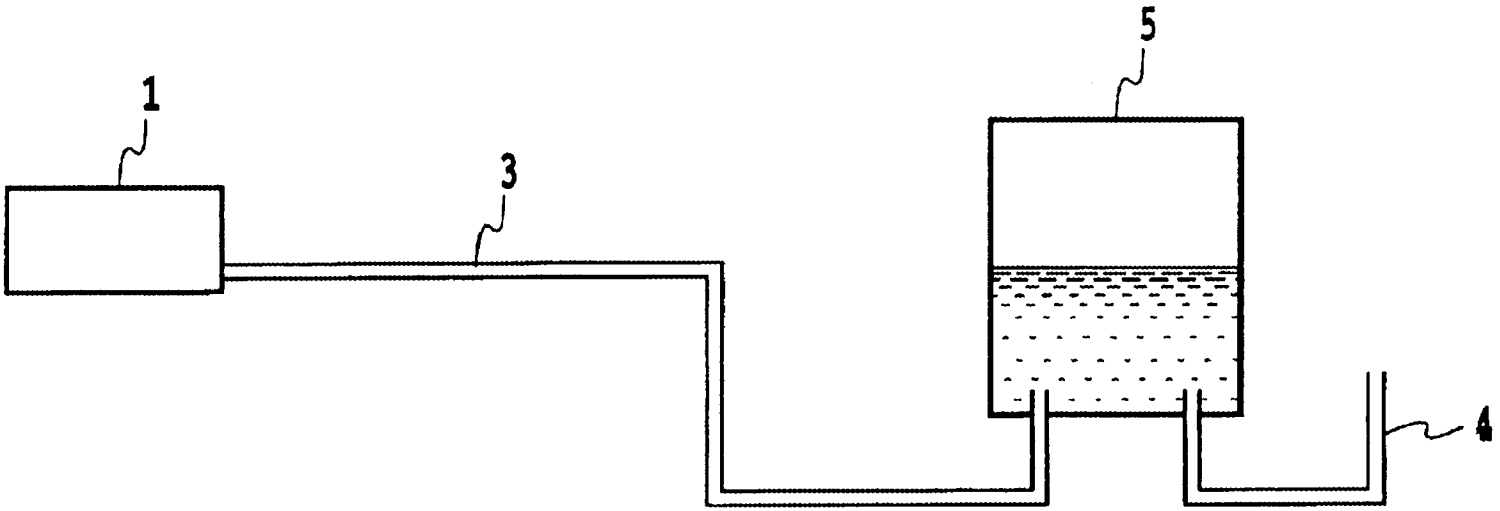
FIG. 7 is a schematic view of an ink jet printing apparatus in which a print head and an ink tank are joined together via tube.

FIG. 6 illustrates an operational procedure according to the second embodiment. Steps S1 to S3 are the same as those in Embodiment 1. In the present embodiment, T1 is 168 hours. Then, at step S3, if the measured time exceeds 168 hours, the procedure proceeds to step S4 to carry out the idle scan eight times. Then, steps S5 to S7 are the same as those in Embodiment 1. Thus, their description is omitted. If the measured time does not exceed T1 at step S3, the procedure proceeds to step S8 to be determined whether or not the measured time T exceeds the predetermined time T2. In the present embodiment, the predetermined time T2 is set at 72 hours. If the measured time T exceeds the predetermined time T2, the idle scan is carried out three times at the subsequent step S9. The procedure then proceeds to step S5. Further, if it is determined at step S8 that the measured time does not exceed T2, the idle scan is not carried out. The procedure then proceeds to step S5 to perform a printing operation.

In the present embodiment, it is determined that the nonuniformity of density of the ink in the tube or sub tank increases consistently with the period during which the apparatus has been out of use. In such a case, the number of idle scan operations is set at a larger value. Consequently, the present printing apparatus is very reliable. In contrast, if the apparatus has been out of use for only a short period, then it is determined that the nonuniform density can be avoided with a small number of idle scans. Thus, if the elapsed time from the preceding printing operation is short, the number of idle scans executed is reduced. This prevents useless idle scans from being performed. Therefore, the printing time can be reduced.

Further, in the present embodiment, two threshold values T1 and T2 are provided. However, the present invention is not limited to this aspect. An arbitrary number of threshold values (determination values) can be set.

As described above, according to the present embodiment, the number of idle scans is properly varied depending on the elapsed time from the end of the preceding printing operation till the start of the current printing operation. Therefore, it is reliably possible to avoid the nonuniform density of the ink in the supply tube, print head, and sub tank (mounted on the carriage together with the print head), while minimizing the number of idle scans to reduce the printing time.

(Third Embodiment)

The present embodiment is characterized in that scan operations are controlled so that the scan speed of an idle scan operation in which the print head scans without ejecting ink deviates from the scan speed of a normal scan operation in which the print head scans while ejecting ink. In the other points, the present embodiment has a configuration similar to those of the first and second embodiments. Thus, the description of these points is omitted.

As described above, the idle scan is carried out in order to vibrate and agitate the ink in the supply tube, print head, and sub-tank (mounted on the carriage together with the print head), thus avoiding the nonuniform density of ink. If it is only necessary to vibrate and agitate much ink, it is effective to increase the number of idle scan. However, this increases the time required for the idle scans.

Thus, it is an object of the present embodiment to accomplish idle scan operations that allow ink to be significantly vibrated and easily agitated, while minimizing the time required for the idle scan. In the present embodiment, the scan speed of idle scan operations is increased. Specifically, the scan speed of the idle scan is higher than that of the normal scan. That is, the normal scan is restricted by driving conditions (driving frequency, printing resolution, and the like) because of associated ink ejection. However, the idle scan is not restricted by the driving conditions because it does not involve ink ejection. Thus, the scan speed of the idle scan can be increased up to the limit of performance of the apparatus. Therefore, the scan speed of the idle scan can be set at a higher value than that of the normal scan.

With the above configuration, the idle scan speed is increased to intensify ink vibration. Accordingly, the ink can be more easily agitated to avoid its nonuniform density. The time required for the idle scan can also be reduced. That is, when the configuration of the third embodiment is applied to the above described first or second embodiment, the nonuniform density of ink can be more successfully avoided, while reducing the time required for the idle scan compared to the first or second embodiment.

In the first and second embodiments, scan operations are not controlled so that the scan speed of an idle scan operation is positively made different from the scan speed of a normal scan operation. Consequently, in controlling scan operations, these embodiments advantageously require a simpler arrangement than the present embodiment, in which the scan speed of an idle scan operation is positively made different from the scan speed of a normal scan operation.

(Fourth Embodiment)

In the first to third embodiments, in order to measure the elapsed time from the end of the preceding printing operation till the start of the current printing operation by the software timer, the end time (latest end time) of the preceding printing operation is read out and then subtracted from the current time. That is, the elapsed time itself is directly measured. However, the present invention is not limited to the configuration that directly measures the elapsed time itself. The elapsed time may be indirectly obtained. That is, the present invention is applicable to any configuration that can obtain information corresponding to the elapsed time.

For example, a counter that counts up every 100 msec. is provided in the printing apparatus. The counter starts counting up at the end of the preceding printing operation and then ends counting up at the start of the current printing operation. A counting value is thus obtained. The counting value thus obtained and a predetermined table such as Table 1, shown below (a table that associates the range to which the counting value belongs with the number of idle scans), are referenced to determine whether or not the idle scan must be executed and the number of idle scans executed. Specifically, information (counting value) is obtained which corresponds to the time elapsing from the end of the preceding printing operation till the start of the current printing operation. Then, the number of idle scans is obtained which corresponds to the range to which the information (counting value) obtained belongs. Subsequently, the idle scan is executed the number of times obtained.

TABLE 1

| Range to which counting value (N) belongs | Number of idle scans |
|---|---|
| $0 \leqq N < K$ | 0 |
| $K \leqq N < L$ | X (X: Positive integer equal to or larger than 1 |
| $L \leqq N < M$ | Y (Y: Integer larger than X) |

As described above, in the present invention, it is possible to directly or indirectly obtain the elapsed time from the end of the preceding printing operation till the start of the current printing operation. What is required is to obtain the information corresponding to the time elapsing from the end of the preceding printing operation till the start of the current printing operation. In this case, it is possible to obtain the information corresponding to the time elapsing from the end of the preceding printing operation till the start of the current printing operation and to determine whether or not to execute the idle scan and the number of idle scans on the basis of the information obtained.

(Other Embodiments)

Embodiment 1 or 2 may be modified to combine with agitating means for the ink tank. The agitating means for the ink tank may be a valve provided in the tube and operated to cause ink to flow as in the previously described conventional example or an agitating mechanism such as blades provided in the tank. In this case, the idle scan may be combined with agitation depending on the time interval from the preceding printing operation.

In the description of the present embodiment, the ink jet printing apparatus has a channel such as a tube. However, of course, an ink jet printing apparatus having no channels can also avoid the nonuniform density of ink in a liquid chamber in the print head according to the present invention.

As described above, the idle scan is carried on the basis of the information corresponding to the elapsed time from the preceding printing operation. This serves to avoid the nonuniform density of ink in the supply tube and print head before the start of a printing operation. Consequently, high-grade images can be outputted. It is also possible to prevent the ejection characteristics of dense ink from being degraded.

Furthermore, the number of idle scans executed is varied depending on the time interval. Therefore, the ejection characteristics can be recovered more effectively and reliably.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus which carries out printing using a print head for ejecting ink, comprising:

scanning means for causing the print head to be scanned across a printing medium;

measuring means for measuring a time from an end of a preceding printing operation until a start of a current printing operation; and determining means for determining whether or not a result of measurement executed by said measuring means exceeds a predetermined time, wherein said scanning means causes at least one idle scan of the print head to be carried out before the start of a printing operation depending on a result of determination made by said determining means.

2. The ink jet printing apparatus as claimed in claim 1, wherein a plurality of different predetermined times are provided so that any can be used by said determining means as the predetermined time for the determination, and said determining means makes the determination in a plurality of stages according to the plurality of different predetermined times.

3. The ink jet printing apparatus as claimed in claim 1, wherein said scanning means varies the number of idle scans executed according to the time measured by said measuring means.

4. The ink jet printing apparatus as claimed in claim 3, wherein if the time measured by said measuring means is relatively long, said scanning means increases the number of idle scans executed, compared to the case in which the measured time is relatively short.

5. The ink jet printing apparatus as claimed in claim 1, wherein the ink is pigment ink.

6. The ink jet printing apparatus as claimed in claim 1, further comprising an ink tank in which the ink is contained, wherein the print head and said ink tank are coupled together via a tube channel through which the ink is supplied.

7. The ink jet printing apparatus as claimed in claim 6, wherein said ink tank comprises agitating means for agitating the ink in said ink tank during the idle scan.

8. The ink jet printing apparatus as claimed in claim 1, wherein said scanning means causes the at least one idle scan of the print head to be carried out at a speed higher than a speed of a normal scan in which the print head is caused to be scanned while ejecting the ink.

9. An ink jet printing apparatus which carries out printing using a print head for ejecting ink, comprising:

scanning means for causing the print head to be scanned across a printing medium;

obtaining means for obtaining information corresponding to a time from an end of a preceding printing operation until a start of a current printing operation; and determining means for determining whether or not to cause at least one idle scan of the print head to be carried out before the start of a printing operation on the basis of the information obtained by said obtaining means.

10. An ink jet printing apparatus which carries out printing using a print head for ejecting ink, comprising:

scanning means for causing the print head to be scanned across a printing medium;

obtaining means for obtaining information corresponding to a time from an end of a preceding printing operation until a start of a current printing operation; and determining means for determining a number of idle scans executed before the start of a printing operation on the basis of the information obtained by said obtaining means, wherein the number of idle scans determined by said determining means is N (N is an integer equal to or greater than 0).

11. An ink jet printing method of carrying out printing using a print head for ejecting ink, comprising:

a scanning step of causing the print head to be scanned across a printing medium;

a measuring step of measuring a time from an end of a preceding printing operation until a start of a current printing operation; and a determining step of determining whether or not a result of measurement executed in said measuring step exceeds a predetermined time, wherein said scanning step includes a step of causing at least one idle scan of the print head to be carried out before the start of a printing operation depending on a result of determination in said determining step.

12. An ink jet printing method of carrying out printing using a print head for ejecting ink, comprising:

a scanning step of causing the print head to be scanned across a printing medium;

an obtaining step of obtaining information corresponding to a time from an end of a preceding printing operation until a start of a current printing operation; and a determining step of determining whether or not to cause at least one idle scan of the print head to be carried out before the start of a printing operation on the basis of the information obtained in said obtaining step.

13. An ink jet printing method of carrying out printing using a print head for ejecting ink, comprising:

a scanning step of causing the print head to be scanned across a printing medium;

an obtaining step of obtaining information corresponding to a time from an end of a preceding printing operation until a start of a current printing operation; and a determining step of determining a number of idle scans executed before the start of a printing operation on the basis of the information obtained in said obtaining step, wherein the number of idle scans detennined in said determining step is N (N is an integer equal to or greater than 0).

* * * * *

UNITED STATES PATENT AND TRADEMARK OFFICE

CERTIFICATE OF CORRECTION

PATENT NO. : 6,951,382 B2
APPLICATION NO. : 10/390729
DATED : October 4, 2005
INVENTOR(S) : Toshiharu Inui et al.

It is certified that error appears in the above-identified patent and that said Letters Patent is hereby corrected as shown below:

COLUMN 5
Line 65, “shown” should read --shown in--.

COLUMN 8
Line 36, “preformed” should read --performed--.

COLUMN 10
Line 32, “scan.” should read --scans.--.

COLUMN 11
Table 1, “than 1” should read --than 1)--.

COLUMN 14
Line 26, “detennined” should read --determined--.

Signed and Sealed this

Seventh Day of November, 2006

JON W. DUDAS
*Director of the United States Patent and Trademark Office*